United States Patent [19]

Scudder

[11] 4,084,340

[45] Apr. 18, 1978

[54] GUN BORE RUST INHIBITING METHOD AND APPARATUS

[76] Inventor: Gilbert Galde Scudder, 725 N. Fig, Escondido, Calif. 92025

[21] Appl. No.: 718,557

[22] Filed: Aug. 30, 1976

[51] Int. Cl.[2] ..... F41C 27/08

[52] U.S. Cl. ..... 42/1 N

[58] Field of Search ..... 42/1 N

[56] References Cited

U.S. PATENT DOCUMENTS

| | | | |
|---|---|---|---|
| 2,465,163 | 3/1949 | Lockwood | 42/1 N |
| 2,557,277 | 6/1951 | Gibson | 42/1 N |
| 2,594,778 | 4/1952 | Hoard | 42/1 N |
| 2,983,063 | 5/1961 | Douville et al. | 42/1 N |
| 2,985,979 | 5/1961 | Doyle et al. | 42/1 N |
| 3,849,923 | 11/1974 | Hawkins | 42/1 N |

FOREIGN PATENT DOCUMENTS

| | | | |
|---|---|---|---|
| 1,022,043 | 12/1952 | France | 42/1 N |
| 596,261 | 12/1947 | United Kingdom | 42/1 N |

*Primary Examiner*—Charles T. Jordan
*Attorney, Agent, or Firm*—Fitch, Even, Tabin & Luedeka

[57] ABSTRACT

A gun barrel corrosion inhibiting apparatus includes a pair of capsule plugs for plugging the open ends of a gun barrel and containing a desiccant which is communicated by means of holes in the capsule with the interior of the barrel. When not in use the two plugs fit together to preserve the dessicant.

4 Claims, 6 Drawing Figures

GUN BORE RUST INHIBITING METHOD AND APPARATUS

BACKGROUND OF THE INVENTION

The present invention relates to rust inhibiting and pertains particularly to method and apparatus for inhibiting rust in gun barrels.

Gun barrel bores are subject to rust and corrosion when not properly cared for. This is a problem which applies to all guns from the smallest pistols to the largest military guns.

Corrosion such as rust and the like not only impedes the accuracy of the weapon but also reduces the life thereof. Accumulations of rust and the like can also make the weapon hazardous to fire.

Rust is frequently caused by accumulations of moisture within the bore of the gun barrel. One approach to rust inhibiting is the application of a coat of oil or other suitable coating to the walls of the bore of the gun barrel. This presents a problem when such coating material is not immediately available. This, also has another drawback, in that if sufficient coating is applied to ensure against the formation of rust, such coating must be removed before the weapon is again fired. Such coating materials and means for removing them are frequently not readily available in the field, whether hunting or in military action.

Another approach to inhibiting rust formation in a gun barrel is to seal the gun barrel with a cover, plug or the like. Such approach can be hazardous if for example, the outer end of the barrel is plugged. A plug which is too tightly fixed within the barrel can result in or cause a rupture of the gun barrel, if the gun is fired without removal of the plug.

SUMMARY AND OBJECTS OF THE INVENTION

Accordingly it is the primary object of the present invention to provide improved means for inhibiting rust formation in gun barrels.

Another object of the present invention is to provide an improved apparatus for inhibiting rust formation within gun barrels.

A further object of the present invention is to provide a method and apparatus utilizing a desiccating agent for inhibiting rust formation within the bore of gun barrels.

In accordance with the primary aspect of the present invention, a method and apparatus for inhibiting rust formation within gun barrels includes capsule means containing a desiccant and having a body portion for close fitting insertion into and sealing at least one end of the gun barrel with means for communicating the desiccant with the bore of the gun barrel.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
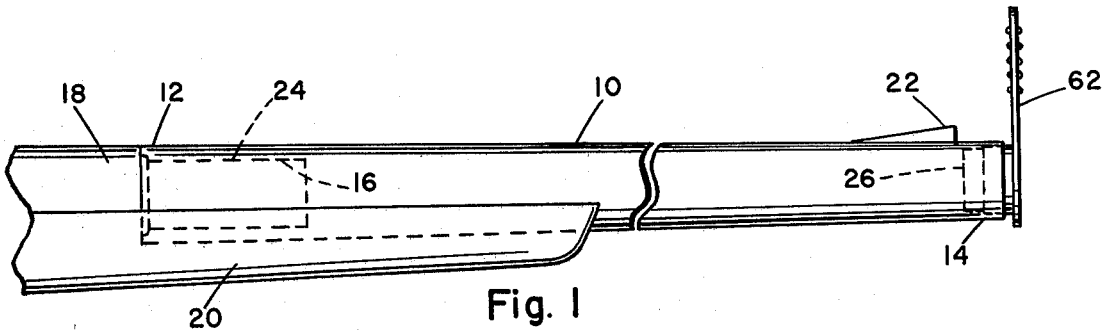
FIG. 1 illustrates a typical gun barrel with breech and muzzle plugs installed.
Figure 2:
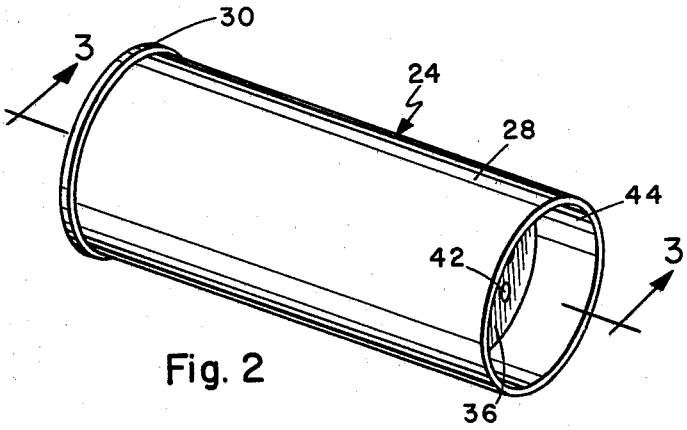
FIG. 2 is a perspective view of the breech plug.
Figure 4:
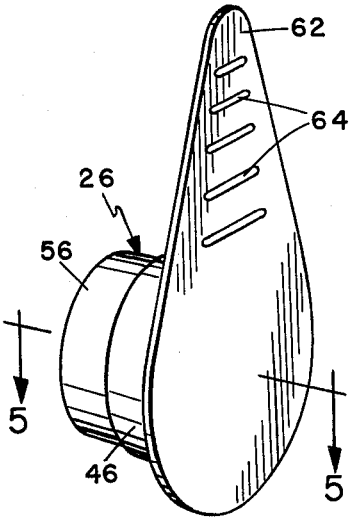
FIG. 4 is a perspective view of the muzzle plug.
Figure 3:
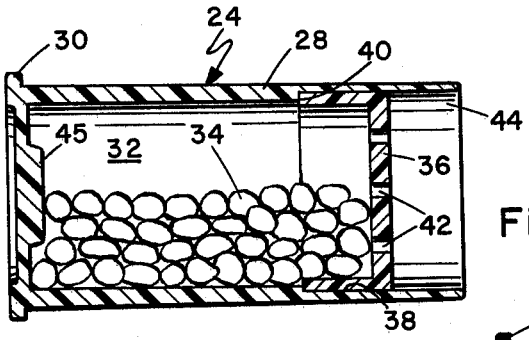
FIG. 3 is a sectional view taken along line 3—3 of FIG. 2.
Figure 5:
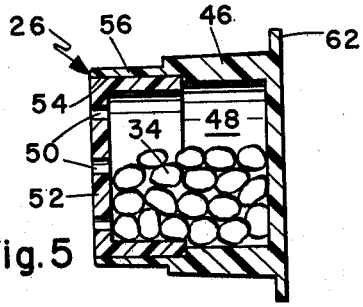
FIG. 5 is a sectional view taken on line 5—5 of FIG. 4.

Turning now to the drawing and particularly to FIG. 1, there is illustrated a gun barrel indicated generally by the numeral 10 having a breech 12 at one end for receiving a cartridge and a muzzle 14 at the opposite end from which a projectile passes from the barrel. The barrel 10 is of the usual design used for a shotgun for example, having a generally cylindrical configuration and a cylindrical bore, not shown. It is to be understood that the principals of the present invention would be applicable to guns of all types including pistols, rifles, shotguns and military guns whether they are breech loading or are the muzzle type. In the illustrated example, the barrel includes a breech or chamber 16 for receiving a cartridge and a breech block 18 for closing the breech. The barrel and breech assembly are mounted on a suitable frame or stock 20. The barrel includes a forward sight 22 for use in aligning the barrel with a target.

In accordance with the present invention, the apparatus comprises one or more capsule plugs for containing a suitable desiccant and for sealing at least one end of the gun barrel. In the case of the muzzle loading gun, a single plug would be sufficient in that only the muzzle end of the barrel would normally be susceptible to receiving a cartridge type plug. The breech end of such a weapon is normally closed except for a primer passage for igniting the charge in the breech or chamber.

In the instance of a breech loading weapon or gun, the apparatus comprises a breech plug or capsule 24 and a muzzle plug or capsule 26. The breech capsule or plug 24 is formed in the shape of a cartridge of the type for the gun for which it is made. This plug is designed or shaped for close fitting insertion into and sealing engagement with the breech of the barrel to seal off that end. The plug comprises a generally cylindrical body member 28 having a radially extending rim 30 and an internal cylindrical chamber 32. The internal chamber 32 defines a cavity for containing a suitable desiccant 34 which may be in the form for example, of granules as illustrated. The desiccant may be any suitable well known moisture absorbing material such as silica gel or the like. Suitable means such as a cap 36 may be used to close the chamber 32 to encapsulate the desiccant 34. The cap 36 may be permanently secured in place or may be removable. This permits the capsule to be re-charged with fresh desiccant when desired. In the illustrated embodiment, the cap 36 extends into an enlarged end bore 38 of the chamber 32 and engages a shoulder 40 defining suitable stop means therefor. The cap is recessed into the body 28, leaving an open end socket 44. Suitable passage means such as a plurality of holes 42 in cap 36 provide communication between the bore of the barrel 10 and the desiccant 34 within the chamber of the plug 24. For convenience, the base or flanged end of plug 24 has a thickened central portion 45 to provide an impact pad for the firing pin of the weapon when dry firing.

The muzzle plug or capsule 26 comprises a housing 46 having an outer tapered or conical surface defining sealing means for engaging the bore at the muzzle of a gun barrel. The housing 46 is constructed to define a cavity 48 in which the desiccant 34 is contained. The plug is preferably tapered or frustoconical in configuration in order to fit different size muzzles. For example, shotguns of a given gauge may be provided with different chokes and therefore have a different diameter of the bore at the muzzle for different guns of the same gauge. A cap 52 fits into an enlarged bore 54 in cavity 48 and seats against an annular shoulder. The cap 52 may be fixed in place when manufactured or is preferably held tightly in place by friction so as to be removable. This permits the muzzle plug or capsule to be recharged when desired. The end of cap 52 has holes 50 for exposing the desiccant to the interior of the gun barrel.

A combined thumb tab and flag 62 is provided on the muzzle plug to serve a dual function of a handle for grasping and removing the plug from the muzzle of a barrel and also serving the function of a flag to warn the gunner that the plug is in the barrel. As will be appreciated from FIG. 1, the tab serving as a flag extends upward in front of the sight 22 so as to be readily visible upon taking aim with the gun. Moreover with the size of the flag is preferably such that it would be readily observed by the gunner when he selects or prepares the gun. As an additional precaution, the member 62 may be constructed of a bright colored or flourescent material so as to be readily noticeable upon preparing the gun for firing. The tab 62 is also provided with a suitable gripping surface which may be prepared in any suitable manner such as with serrations or ridges 64 as shown.

Figure 6:
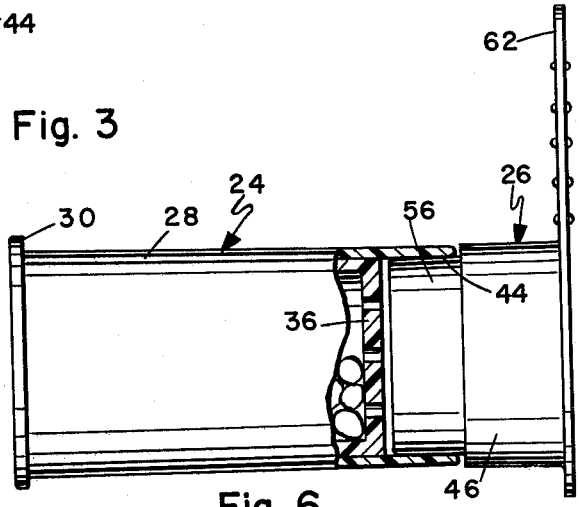
FIG. 6 is a side elevation view, partially cut away, showing the breech and muzzle plugs interfitted.

In order to prevent deterioration of the dessicant when the plugs are removed from the weapon or stored, body 46 of plug 26 has a reduced diameter end portion 56, which is a close fit in socket 44 of plug 24. The two plugs can thus be fitted together, as in FIG. 6, with the perforated ends confronting and completely enclosed.

The plug members 24 and 26 are preferably constructed of a suitable material such as a resilient plastic so as to be easily and inexpensively constructed and so as to also serve the function as seal means within the barrel. Suitable materials for example, are polyethelyene, polypropolene, and rubber. Also, the muzzle plug for rifles may be grooved to fit the rifling. This is especially a desirable feature for large bore guns, such as military weapons.

While the present invention has been described and illustrated by means of specific embodiments, it appears to be understood that numerous changes and modifications may be made therein without departing from the spirit and scope of the invention as defined in the appended claims.

Having described my invention, I now claim:

1. Apparatus for inhibiting rust in the bore of a barrel of a gun having a muzzle and a breech, said apparatus comprising:

first generally cylindrically shaped hollow capsule means with one end open and containing a desiccant therein and having a passage means in said one end, said first capsule means having a slightly tapered outer surface toward said one end, the outer surface being of a size so that said first capsule means can be inserted into the muzzle of the gun in substantially sealing engagement, with the passage means in communication with the bore of the gun;

second generally cylindrically shaped hollow capsule means with one end open and containing desiccant therein and having passage means in said one end, the passage means of said second capsule means being located axially inward from said one end thereof so that a cylindrical side wall extends beyond said passage means, the inside surface of said side wall being slightly smaller than the outer surface of said one end of said first capsule means, said second capsule means having a slightly tapered outer surface toward said one end, the outer surface being of a size so that said second capsule means can be inserted into the breech of the gun in substantially sealing engagement, with the passage means in communication with the bore of the gun;

the first and second capsule means being adapted to be interfitted with the outer surface of said one end of said first capsule means engaging the inside surface of said one end of said second capsule means so that said respective passage means only communicates with each other and thereby substantially prevent depletion of said desiccant.

2. Apparatus as defined in claim 1 wherein the end opposite said one end of said first capsule means has a tab extending outwardly therefrom generally transverse to the axis thereof beyond the outer surface of said gun barrel when said first capsule means is inserted in the muzzle of the same, said tab defining gripping means for removing said first capsule means.

3. Apparatus as defined in claim 2 wherein said tab extends outwardly a substantial distance along a portion thereof for providing a warning indicator for indicating the presence of said first capsule means in the muzzle.

4. Apparatus as defined in claim 1 wherein each of said passage means comprises an insert for fitting within the respective capsule means and having perforations therein.

* * * * *